US006278855B1

(12) United States Patent
Maess et al.

(10) Patent No.: US 6,278,855 B1
(45) Date of Patent: Aug. 21, 2001

(54) MULTICOLOR ELECTROPHOTOGRAPHIC PRINTING DEVICE WITH BIPOLAR TONER

(75) Inventors: Volkhard Maess, Erding; Martin Schleusener, Zorneding, both of (DE)

(73) Assignee: Oce Printing Systems GmbH, Poing (DE)

( * ) Notice: Subject to any disclaimer, the term of this patent is extended or adjusted under 35 U.S.C. 154(b) by 0 days.

(21) Appl. No.: 09/284,662

(22) PCT Filed: Oct. 16, 1997

(86) PCT No.: PCT/DE97/02413

§ 371 Date: Aug. 23, 1999

§ 102(e) Date: Aug. 23, 1999

(87) PCT Pub. No.: WO98/18050

PCT Pub. Date: Apr. 30, 1998

(30) Foreign Application Priority Data

Oct. 17, 1996 (DE) ..... 196 42 892

(51) Int. Cl.[7] ..... G03G 15/01
(52) U.S. Cl. ..... 399/223; 399/296
(58) Field of Search ..... 399/223, 178, 399/231, 232, 296

(56) References Cited

U.S. PATENT DOCUMENTS 4,078,929 3/1978 Gundlach .
4,515,462 5/1985 Yoneda .
5,122,843 * 6/1992 Yokoyama et al. ..... 399/231
5,155,541 10/1992 Loce et al. .
5,745,818 * 4/1998 Kumasaka et al. ..... 399/223 X
5,837,408 * 11/1998 Parker et al. ..... 399/232 X
5,978,628 * 11/1999 Rees ..... 399/178
5,999,783 * 12/1999 Folkins ..... 399/231 X

FOREIGN PATENT DOCUMENTS 44 08 978 A1 9/1994 (DE) .
0 405 991 A1 1/1991 (EP) .
0 606 141 A2 7/1994 (EP) .

* cited by examiner

*Primary Examiner*—Susan S. Y. Lee
(74) *Attorney, Agent, or Firm*—Schiff Hardin & Waite

(57) ABSTRACT

A multicolor printer uses toner of two polarities applied on a photo conductor layer prior to the two toners being applied to a carrier. The photo conductor layer is provided with an image-wise illumination with regions of different illumination to form regions of different potentials. The regions of different potentials are developed by applying the toner of two polarities. Further colors of toner may be used, provided illumination with corresponding different illumination and provided charging of the photo conductor layer to change relative potentials is performed. An overall illumination of the photo conductor layer between developing steps changes potential levels on regions not covered by toner but not in areas covered by toner.

17 Claims, 5 Drawing Sheets

FIG.4a
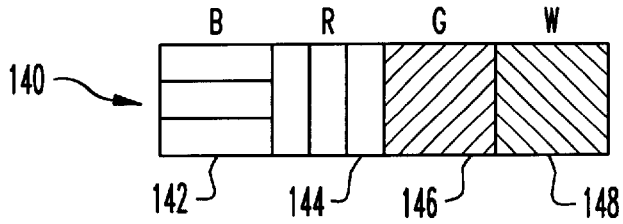
FIG.4b
FIG.4c
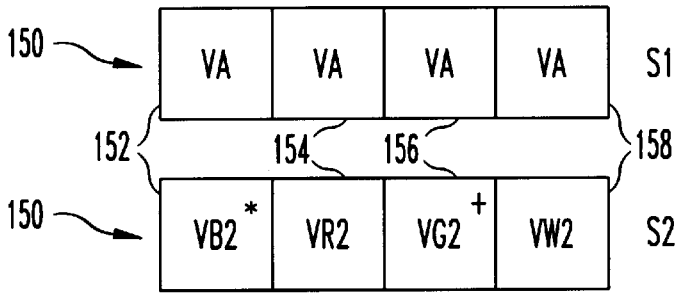
FIG.4d
FIG.4e
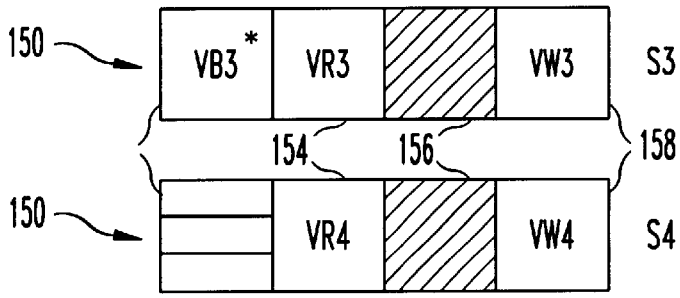
FIG.4f
FIG.4g
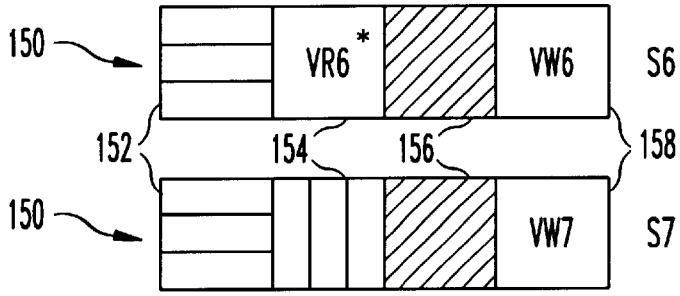
FIG.4h
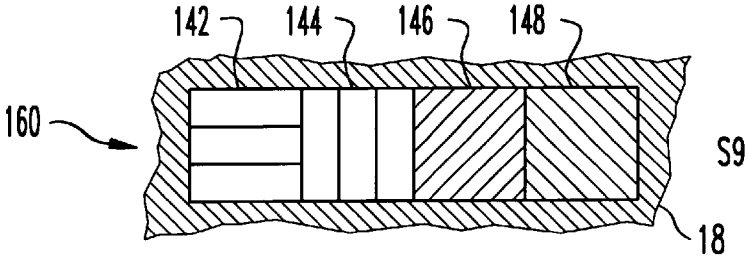

MULTICOLOR ELECTROPHOTOGRAPHIC PRINTING DEVICE WITH BIPOLAR TONER

BACKGROUND OF THE INVENTION

1. Field of the Invention

The present invention is directed to a method for the electrophotographic printing of a print image having a plurality of colors on a carrier.

2. Description of the Related Art

U.S. Pat. No. 4,078,929 discloses a method for electrophotographic printing with two colors. This method also bears the name "Tri-Level Method". In this method, a print image contains at least one first image element of a first color and at least one third image element with a third color. A second image element of the print image has a background color of the image carrier, so that no toner particles are to be applied.

The first image element is allocated to a first surface element of a photo conductor layer. The photo conductor layer and an electrode layer carrying a predetermined reference potential are contained in a light-sensitive layer system. The reference potential is usually zero potential. Likewise, the second image element is allocated to a second surface element or region and the third image element is allocated to a third surface element of the photo conductor layer. What is disadvantageous in the tri-level method is that only toner particles of two colors can be applied in a print image. A color mixing with the assistance of three primary colors, accordingly, is precluded without repeating the process. A plurality of printing events are possible for color mixing, whereby a printing event contains the steps of charging, image-wise illumination and developing.

European Published Application EP 0 606 141 A2 discloses a printer that can be employed for the electrophotographic printing of a print image with a number of colors. The maximum plurality of colors with one illumination step, however, is limited to three colors. For example, it is not possible to print additional, decorative colors such as, for example, gold or silver with exact registration in addition to the three primary colors. Given a printer according to the European Published Application, moreover, a layer system that is composed of four layers is employed. Added outlay is needed in order to manufacture this layer system since four layers instead of two layers are to be arranged on top of one another.

Further, two light-sensitive layers contained in the layer system must be illuminated with two light beams that respectively have different wavelengths. In a first version of the print according to the European Published Application, the photoconductor is conducted past an illumination station for the image-wise illuminating twice. As a result thereof, the printing speed is reduced to half. An illumination station must offer two different light beams in both passes. The outlay for the illumination is therefore doubled, for example in view of generating the illumination signals and in view of the demands made of the optical system with respect to the imaging errors.

In a second version of the European Published Application, the light-sensitive layer system is conducted past two illumination locations in one pass. However, two illumination beams must still be offered at each of these illumination locations. The demands made of the imaging precision of the optical system employed are more stringent in the second version. Thus, TE light waves (transversal-electromagnetic) are employed for the first illumination station and TM light waves (transversal-magnetic) are employed in the second illumination station for the different wavelengths of the two illuminating beams.

U.S. Pat. No. 5,155,541 discloses a printing method wherein the tri-level method has been further-developed for printing at least three colors.

SUMMARY OF THE INVENTION

An object of the present invention is to provide a method for the electrophotographic printing of a print image with at least three colors that allows a printing with high printing quality and that can be implemented on a simply constructed printer.

This and other objects of the invention are achieved by a method for the electrophotographic printing of a print image with a plurality of colors on a carrier, wherein a layer system is charged to a starting potential; at least three different potentials, namely a first, third and fourth potential, are generated on the layer system by image-wise illuminating, the third potential has a value that is greater in terms of amount than the fourth potential and the first potential has a value that is greater in terms of amount than the third potential; in a developing step with color particles of a first color and first polarity, these color particles are applied onto locations having the first potential; in a developing step with color particles of a fourth color of the other polarity, these color particles are applied onto locations having the fourth potential; the third potential is lowered in terms of amount by uniform illuminating to a value below the momentary value of the fourth potential that is present after the developing step with color particles of the fourth color; and in a developing step with color particles of a third color of the other polarity, these color particles are deposited at locations having the lowered, third potential; the potential on surface elements already covered with color particles is increased in terms of amount at least once before the uniform illumination. Compared to the known method of the aforementioned Published Application EP 0 606 141 A2, picture elements with at least three different colors of the color particles applied in the developing steps are contained in the print image in the invention. Despite foregoing subtractive color mixing in a printing procedure given the method of the invention, additive color mixing can be produced by color particles arranged in juxtaposition. In the method of the invention, an image-wise illumination step with only a single light frequency and light of one polarization type is required, so that a simple image-wise illumination is implemented. The light-sensitive layer system can be simply constructed in the method of the invention. Compared to the European Patent document EP 0 606 141 A2, a photoconductor layer and an intermediate layer can be eliminated when printing at least three colors. A subtractive color mixing can ensue in that a further print image is printed with optimally exact registration in a following printing event. The further print image is thereby generated on the same photoconductor after removal of the first print image or is generated on a further photoconductor.

The invention is based on the perception that the printing quality given a multiple illumination for printing a print image decreases since, due to unavoidable imaging errors and a positioning of the layer system affected by tolerances, it cannot be assured that both illumination steps lead to a positional exact positioning of the picture elements of the print image. Only one image-wise illumination step is therefore implemented in the invention. Moreover, imaging errors are minimized in the invention in that the light-sensitive layer system employed contains only one electrode layer carrying a predetermined reference potential and one photoconductor layer that, for example, are mechanically and electrically connected in large-area fashion.

After the application of charged color particles of the respective color onto at least one of the surface elements, the potential on this surface element is increased in terms of amount (made more positive from a negative value) in the invention. The light source with the uniform light distribution thus need only emit a lower optical energy since the potentials have to be lowered by only a smaller amount. As a result thereof, the contrast range which has been predetermined by the initial potential can be well-utilized.

In a first exemplary embodiment of the invention, the print image contains at least one first image element of a first color, at least one second image element with the color of the carrier, at least one third image element of a third color and at least one fourth image element of a fourth color. An additive color mixing with three colors is thus also possible, in particular, when a white carrier is employed. The second image element can be foregone in the rare case wherein all picture elements of the print image are covered with color particles. In this case, all measures cited below relating to the second picture element or, respectively, a second surface element are omitted.

A first surface element of the photoconductor layer is allocated to the first picture element, a second surface element is allocated to the second picture element, a third surface element is allocated to the third picture element and a fourth surface element is allocated to the fourth picture element. Since the surface elements for picture elements of different colors are each only illuminated once in the invention and, thus, for example, the aforementioned repositioning for a second illuminating is eliminated, it can be assured that the surface elements are aligned exactly positionally exact relative to one another. Given employment of colors that have an adequately great distance from one another in the color space, an additive color mixing of a great number of other colors can be implemented with three colors. For example, red can thus be employed as the first color, blue as the second color and green as the third color. The term positionally exact means that neighboring surface elements do not overlap or overlap only insignificantly, and that no or nearly no blank spaces arise between neighboring surface elements. By covering surface elements that are allocated to picture elements of different colors, undesired toner superimpositions occur that lead to a poor print image. The color of the carrier material is unintentionally visible due to spaces between picture elements, as a result whereof a poor print image likewise arises. In the invention, an overlap and a creation of interspaces are avoided by the one-time, image-wise illumination with high precision. The result is a high printing quality.

In the first exemplary embodiment of the invention, the surface elements—after a previous charging to an initial potential—are differently illuminated such that the fourth surface element has a fourth potential after the illumination, the third surface element has a third potential that is higher in amount compared to the fourth potential, the second surface element has a second potential that is higher in amount compared to the third potential and the first surface element has a first potential that is higher in terms of amount compared to the second potential. This different illumination is referred to as image-wise illumination. This graduation of potentials achieves that every color has exactly one value of potential allocated to it. A further image-wise exposing step wherein surface elements are irradiated with different optical energies can be omitted since an unambiguous allocation between values of potentials and colors is already present following a single image-wise illumination step.

After the image-wise illumination, the surface elements in the first exemplary embodiment of the invention are developed with color particles of the first color in a first developing step. Color particles of the first color are thereby only deposited onto the first surface elements. No toner particles are deposited onto the other surface elements. The first surface elements have the highest potential in terms of amount at the point in time of this developing step. The developing method employed for applying the color particles of the first color is a matter of developing charged surface elements (charged area development). In the first exemplary embodiment of the invention, the color particles of the first color are positively charged in order to facilitate or, respectively, enable the selective deposit onto the first surface elements.

In a second developing step, the surface elements in the first exemplary embodiment of the invention are developed with color particles of the fourth color. Negatively charged particles of the fourth color are thereby deposited onto the fourth surface elements. At the point in time of this developing step, the fourth surface elements have the lowest potential in terms of amount. The second developing step, accordingly, is a matter of developing discharged surface elements (also referred to as discharge area development).

After the first two developing steps, the surface elements in the invention are arranged close to a light source having an approximately uniform light distribution. The arranging can, for example, be achieved by conducting the surface elements past the light source or by conducting the light source past the surface elements. However, a static arranging of the surface elements relative to a light source with uniform light distribution is also possible. Either the surface elements of the layer system allocated to the print image are thereby simultaneously arranged opposite the light source or the surface elements are successively arranged opposite the light source, whereby, for example, surface elements that are allocated to image elements of a line can be simultaneously illuminated. The invention and the first exemplary embodiment are based on the perception that further color particles of further colors can be deposited when similar relationships of potential as preceding the second developing step are created. By depositing the negatively charged color particles in the second developing step, the potential on the fourth surface elements is increased in terms of amount. The first surface element covered with color particles and the fourth surface element covered with color particles in the invention are illuminated considerably less than are the non-covered surface elements, since the light does not penetrate through the deposited color particles or, respectively, penetrates through the deposited color particles only highly attenuated. The potential on the non-covered second surface element and on the non-covered third surface element, however, is diminished in terms of amount since the incident optical energy is not absorbed by color particles. The potential on the third surface element is lower in terms of amount after the exposing with the same optical energy than the momentary potential on the fourth surface element. Accordingly, conditions similar to those that existed for the third surface element before the second developing step are now present for the second surface element. In a third developing step in the invention, color particles of the third color are deposited onto the third surface elements. No color particles are deposited onto the second surface elements. When transferring the color particles deposited on the other surface elements onto the carrier in a later method step, the carrier remains free of color particles in areas that are allocated to the second surface elements in the transfer. As a result thereof, the print image ultimately has picture elements with the color of the carrier.

In another exemplary embodiment, the print image contains at least one further picture element of a further color. In the image-wise exposing step, a further potential is generated on the further surface element that lies between the first and the third potential or, respectively, between the second and the third potential. By repeatedly arranging the layer system close to the light source with approximately uniform light distribution or, respectively, close to further light sources, the further potential is lowered in steps until it is lower in terms of amount than the momentary potentials on the surface elements already covered with color particles. When this condition is achieved, color particles of the further color can be deposited on the further surface element in a further developing step. In the invention, the possible number of further picture elements with respectively different colors is limited only by the height of the initial potential, since the potentials that are allocated to the individual colors should lie at least 300 V apart.

The invention is also directed to a method wherein a positive starting potential is employed instead of the negative starting potential, whereby the respective momentary potentials on the surface elements have a positive operational sign instead of a negative operational sign. Moreover, negatively charged color particles are employed instead of positively charged color particles. The invention is thus directed to two potential curves on the surface elements that differ only in terms of the operational signs of the potentials. The technical effects are the same given both curves of potential.

In one exemplary embodiment of the invention, the carrier can be directly printed or, in another exemplary embodiment of the invention, the carrier can be indirectly printed with the assistance of an intermediate carrier, proceeding from which the particles are transferred onto the carrier. By employing an intermediate carrier, the light-sensitive layer system can be gently treated, since the material of the intermediate carrier can be selected such that minimum mechanical stressing of the surface of the photo conductor layer occurs given contact between the intermediate carrier and the layer system. For example, sheet-shaped material or continuous-form paper may be employed as the carrier.

The invention is also directed to an electrophotographic printer having a light-sensitive layer system that contains an electrode layer carrying a predetermined reference potential and a photo conductor layer, a charging means for generating a starting potential on the photo conductor layer, an illumination means for the image-wise illumination of the photo conductor layer, a first developer station for applying color particles of a first polarity and a first color onto the layer system, a second developer station for depositing color particles of the other polarity and a second color onto the layer system, at least one total illumination unit for uniform illumination of the photo conductor layer, and having at least one further developer station for applying color particles of the other polarity and a further color onto the layer system, and including at least one potential-increasing means for increasing the respectively lowest potential on the layer system in terms of amount. The aforementioned effects with respect to the method also apply to the printer of the invention. Compared to the printer disclosed by the European publication, the printer of the invention is distinguished by a simple structure in addition to the properties. In particular, the layer system is constructed of only two layers, and only one image-wise exposing step is needed per print image, so that only one image-wise exposing unit with a simple control is required.

The invention can be implemented with a dry toner that contains only solid color particles, or with a liquid toner in which, for example, the color particles are contained in a liquid.

BRIEF DESCRIPTION OF THE DRAWINGS

The invention is described below with reference to exemplary embodiments.

FIGS. 4*a*–4*h* are enlarged schematic illustrations showing the condition of surface elements of the photo conductor in various method steps.

DETAILED DESCRIPTION OF THE PREFERRED EMBODIMENTS

Figure 1:
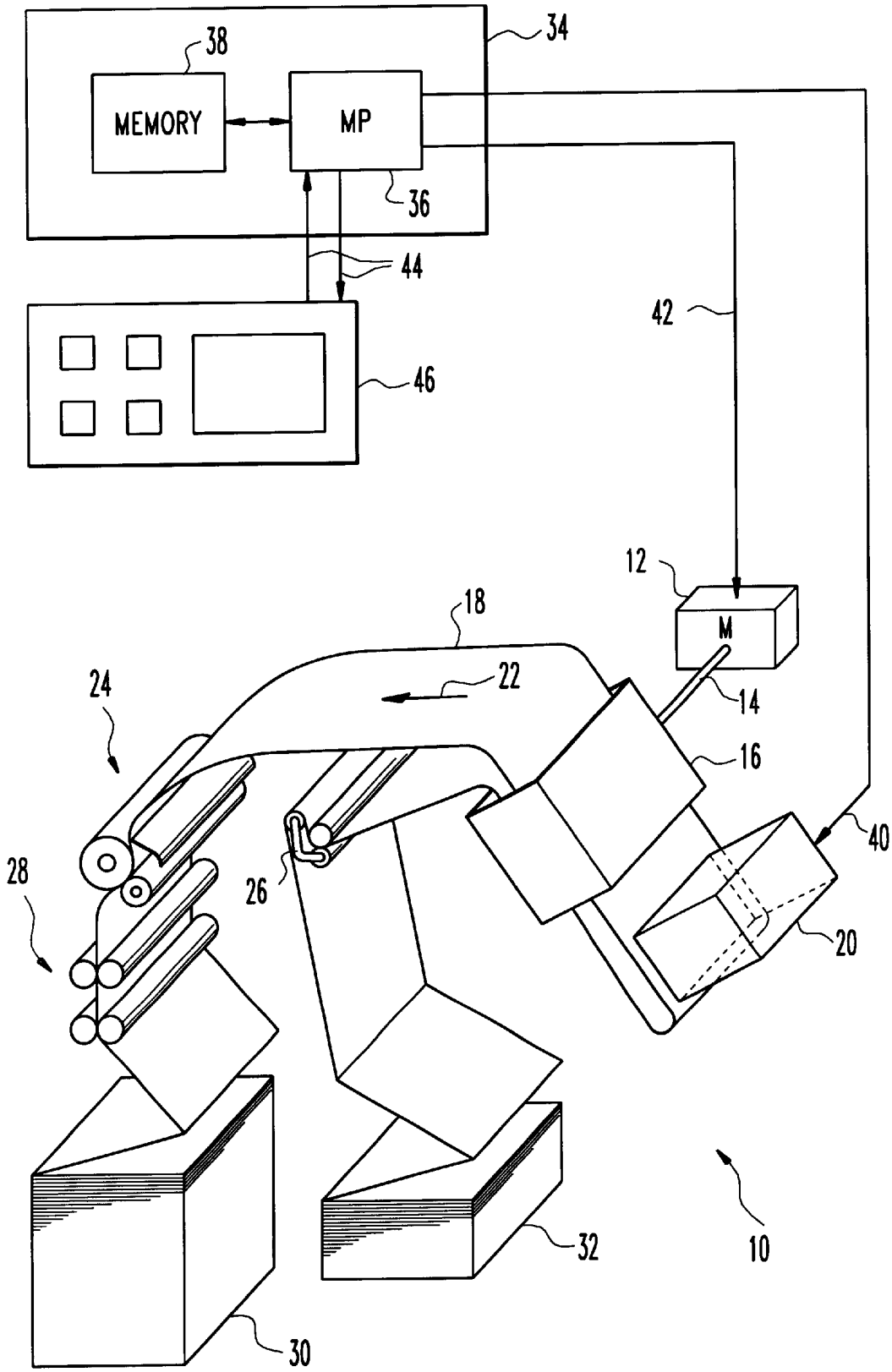
FIG. 1 is a schematic illustration, partially in perspective of an electrophotographic printer with critical electronic and mechanical function units.

FIG. 1 shows a schematic illustration of an electrophotographic printer 10 for the implementation of an exemplary embodiment of the method of the invention. The printer 10 has a conveyor means 16 driven by a motor 12 and a shaft 14 for conveying a continuous-form carrier material 18 past a printing unit 20 essentially according to a predetermined printing speed VD. Alternatively to the continuous-form carrier material 18, single sheets can also be printed given a modified transport. The printing unit 20 generates a multicolored toner image that, for example, is transferred onto the carrier material 18 with the assistance of a corona means (see FIG. 2).

After the carrier material 18 has been conveyed past the printing unit 20 in the direction of an arrow 22 illustrating the conveying direction, it is supplied to a fixing station 24 in which the still smearable toner image is fused to be smear-resistant to the carrier material 18 with the assistance of pressure and temperature. As viewed in the conveying direction 22, a first deflection unit 26 is arranged preceding the printing unit 20, this conducting the carrier material 18 to the printing unit 20. A further deflection unit 28 stacks the printed carrier material 18 onto a stack 30. The carrier material 18 is taken from a stack 32 by the first deflection unit 26 at the beginning of the printing process. Instead of the two stacks 30 and 32, rolls are also employed on which the carrier material 18 is rolled up.

The printing process is controlled by a print control 34 that contains at least one microprocessor 36 and one memory 38. The microprocessor 36 processes a printing program deposited in the memory 38 and thereby controls the printing process. The print control 34 also edits image data that is likewise stored in the memory 38 and transfers the edited image data via a control and data bus 40 to the printing unit 20. The motor 12 is driven such by the print control 34 via a control line 42 that the carrier material 18 has a conveying speed that essentially coincides with the printing speed VD. The print control 34 is connected via data lines 44 to an input/output means 46 via which, among other things, control commands for starting the printing process are input by an operator.

Figure 2:
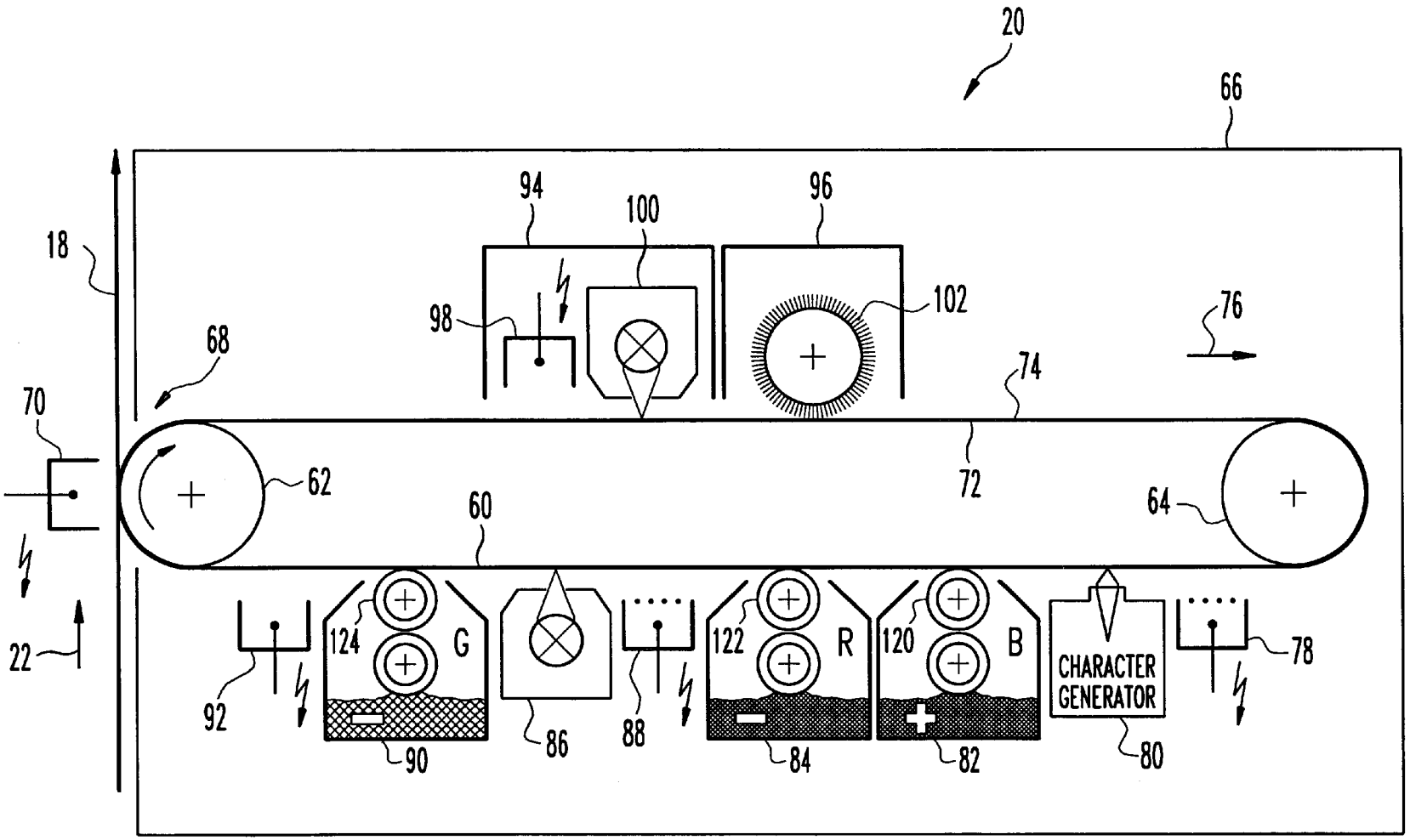
FIG. 2 is a schematic illustration of the printing unit of the printer with critical functional components.

FIG. 2 shows the printing unit 20 of the printer 10 with critical functional components. The printing unit 20 contains a photo conductor 60 that is composed of a flexible layer system and is guided around two deflection rollers 62 and 64 in the fashion of a conveyor belt. The deflection roller 64 is driven by a drive motor (not shown) that is driven by the print control 34 and via the control and data bus 40. The printing unit 20 is surrounded by an opaque chassis 66 of a stable material. The chassis 66 has an opening 68 at which the photo conductor 60 is conducted past in the inside of the printing unit 20. Outside the printing unit 20, the carrier material 18 is conducted past at the opening 68. No light can impinge onto the photo conductor 60 from the outside through the opening 68 since the entire printer 10 has an opaque cladding. The opening 68 has a corona means 70 lying arranged opposite it, so that a toner image located on the photo conductor 60 is transferred onto the carrier material 18 with the corona means 70. The corona means 70 is also referred to as transfer printing means.

The photo conductor 60 contains an electrode layer 72 carrying a zero potential and a photo conductor layer 74 arranged approximately parallel thereto that is in mechanical and electrical contact with the electrode layer 72 in large-area fashion. The photo conductor 60 is moved in the direction of an arrow 76 by the deflection rollers 62, 64. A surface strip of the photo conductor 60 lying transversely relative to the conveying direction of the photo conductor 60 is thereby successively conducted past a charging means 78, a character generator 80, a developing station 82 for depositing black toner particles, a developing station 84 for depositing blue toner particles, a charging means 86, a total exposing unit 88, a developing station 90 for depositing red toner particles, a recharging station 92, the corona means 70, an erasing means 94 and a cleaning means 96.

Figure 3:
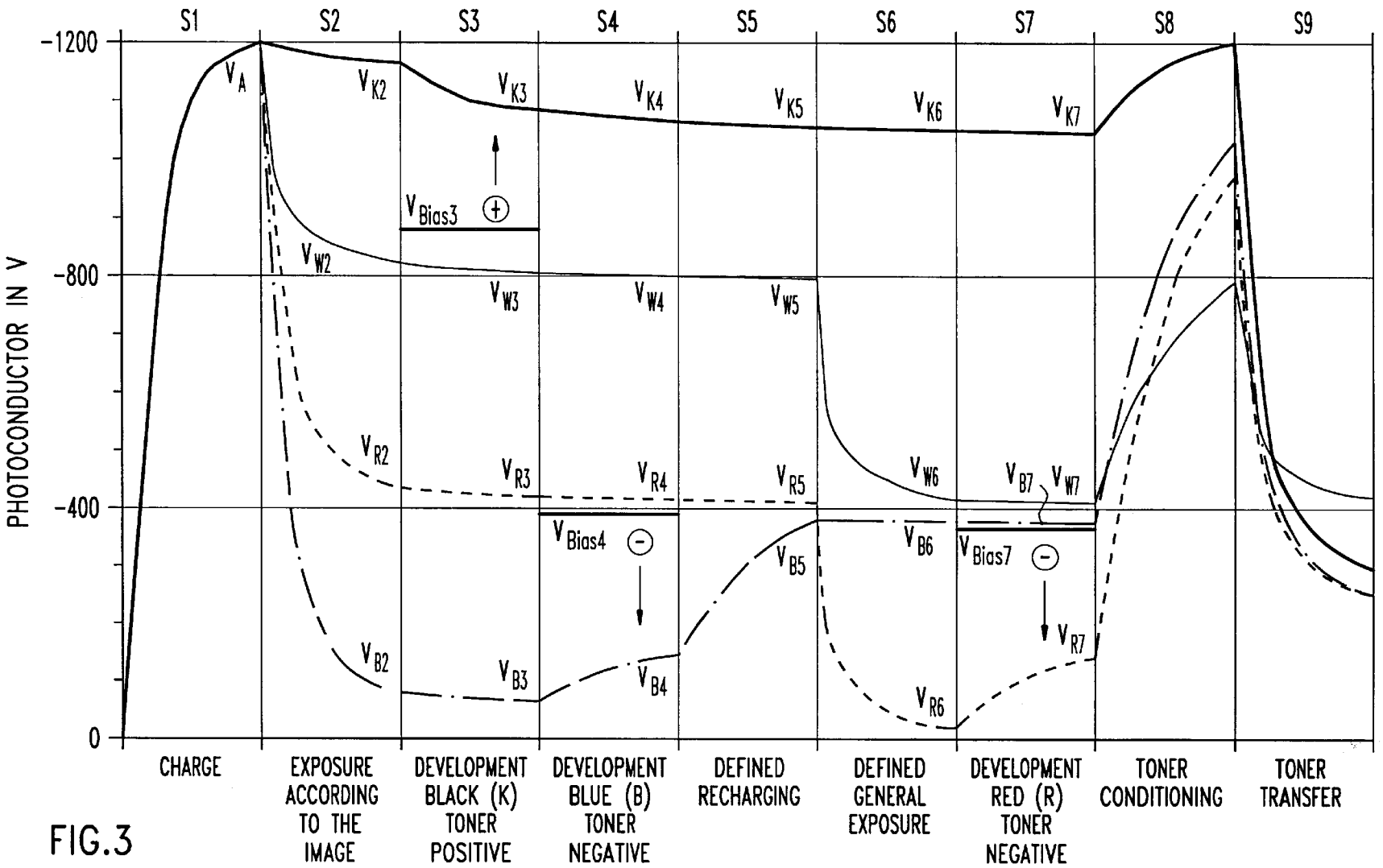
FIG. 3 is a graph of the curve of potential on the photo conductor in an exposing step and two toner polarities.

The charging means 78 contains a corona means arranged transversely relative to the conveying direction 76 that charges a given surface strip portion of the photo conductor 60 lying respectively transversely relative to the conveying direction 76 and located in the immediate proximity of the charging means 78 such that an initial potential VA of approximately −1200 V arises on the surface of the photo conductor layer 74 in the region of the surface strip portion (see FIG. 3, step S1).

The character generator 80 contains a line of light-emitting diodes arranged transversely relative to the conveying direction 76 that respectively illuminate a region of the photo conductor 60 image-wise lying transversely relative to the conveying direction 76. The character generator 80 is driven such by the print control 34 that respective image signals for picture elements of a line of the print image are simultaneously converted into luminous signals of the light-emitting diodes. Due to the illumination of the photo conductor 60, the potential on the illuminated surface elements of the photo conductor 60 rises since the photo conductor 60 conducts better in the illuminated regions, as a result charged carriers can flow from the surface of the photo conductor layer 74 to the electrode layer 72 in the region of the illuminated surface elements. Surface elements on which black toner particles are to be deposited are not illuminated; surface elements on which no toner particles are to be deposited are illuminated with a first optical energy; surface elements on which red toner particles are to be deposited are illuminated with a second optical energy that is higher compared to the first optical energy, and surface elements onto which blue toner particles are to be deposited later are illuminated with a third optical energy that is higher compared to the second optical energy. With increasing luminous energy, the potential on the respective surface elements increases more greatly, i.e. the potential varies in a positive direction from the initial negative charge (see FIG. 3, step S2).

The developer station 82 deposits positively charged color particles having the color black K onto surface elements that were not illuminated, depositing them thereon upon employment of an auxiliary electrode 120 having a potential VBIAS3. The exact functioning mechanism is explained later with reference to FIG. 3 (step S3).

The developer station 84 deposits negatively charged color particles having the color blue B onto surface elements that were illuminated with the third luminous energy, depositing them thereon upon employment of an auxiliary electrode 122 having a potential VBIAS4. The exact functioning mechanism of the developer station 84 is likewise explained later with reference to FIG. 3 (step S4).

Due to the deposit of the negatively charged, blue toner particles, the potential on the surface elements that were illuminated with the third luminous energy is again lowered, i.e. modified in a negative potential direction. In order to lower the potential on these surface elements even farther, the photo conductor 60 is conducted past the charging device 86. The charging device 86 contains a corona wire stretched transversely relatively to the conveying direction 76 that has a potential that effects a charging of the surface of the photo conductor layer 74 to a potential VB5 in the region of the surface elements covered with blue toner particles. The potential VB5 is somewhat smaller in terms of amount than the momentary potential VR5 on the surface elements that were illuminated with the second luminous energy (see FIG. 3, step S5).

Subsequently, the strip of the photo conductor 60 under consideration is conducted past the total illumination unit 88. The total illumination unit 88 contains a laser diode that beams optical energy into an optical fiber array arranged transversely relative to the conveying direction 76 of the photo conductor 60. The optical fiber array is fashioned such that essentially the same optical energy is beamed out over its entire length. The light of the total illumination unit 88 cannot beam through black or blue toner particles that have already been deposited since it is absorbed by the toner particles. When the light of the total illumination unit 88, however, impinges surface elements of the photo conductor layer 74 that are not yet covered with toner particles, then the potential on these surface elements is increased, i.e. it is modified in the positive direction (see FIG. 3, step S6).

The developer station 90 deposits negatively charged toner particles having the color red R onto surface elements that were illuminated with the second luminous energy, depositing these with the assistance of an auxiliary electrode 124 having a potential VBIAS7. The exact functioning of the deposit of the red toner particles is likewise explained later with reference to FIG. 3 (step S7).

Due to the application of the negatively charged, red toner particles, the potential on the surface elements that were illuminated with the second optical energy is lowered to the potential VR7, i.e. modified in the negative potential direction.

In the recharging station 92, the positively charged, black toner particles are repolarized, so that nearly all toner particles deposited on the photoconductor 60 are negatively charged. A recharging thereby ensues on all surface elements of the photoconductor, as a result whereof the potentials on the surface elements diminish, i.e. change in a negative direction (see FIG. 3, step S8). What is achieved by this measure is that the transfer of the toner image from the photo conductor 60 onto the carrier material 18 is reliably implemented with the assistance of the corona means 70 (see FIG. 3, step S9).

After the transfer of the toner image with the assistance of the corona means 70, the photo conductor 60, which is now essentially free of toner particles, is conducted past the erasing means 94. The erasing means 94 contains a corona means 98 and an illumination unit 100 with which the residual charges present on the photo conductor 60 are removed.

Toner particles that still remain on the photo conductor 60 after the transfer of the toner image are removed from the photo conductor 60 in the cleaning means 96 with the assistance of a brush 102. After being conducted past the cleaning means 96, the strip of the photo conductor 60 under consideration is again in a clean initial condition and has approximately the same potential at all locations.

FIG. 3 shows the curve of potential on the surface of the strip of the photo conductor 60 under consideration given an illuminating step and two toner polarities. The time, which is subdivided into nine successive time steps S1 through S9 is shown progressively on the abscissa axis. The potential on the surface of the photo conductor layer 74 with respect to the potential on the electrode layer 72 is shown on the ordinate axis.

In step S1, the potential on the surface of the photo conductor layer 74 is shifted in a negative direction toward the initial potential VA due to the influence of the charging means 78, the initial potential VA having the value of −1200 V as already mentioned.

In step S2, the image-wise illuminating ensues with the assistance of the character generator 80, as a result whereof the curve of potential that is shown is established on the surface of the photo conductor layer 74. Surface elements that are not to be covered with black toner particles later are not illuminated. The potential VA on these surface elements shifts only slightly in a positive direction during the course of the step S2 to a value VK2 due to a self-discharge of the photo conductor 60 that cannot be suppressed. The potential on the surface elements that were illuminated with the first optical energy changes in a positive direction to a value VW2 of approximately −800 V. The potential on the surface elements that were illuminated with the second optical energy shifts in a positive direction during the course of the step S2 to a value of potential VR2 of approximately −400 V. The potential on the surface elements that were illuminated with the third optical energy changes in a positive direction to an approximate potential value VB2 of approximately −100 V in the step S2.

In step S3, positive black toner particles are deposited by the developer station 82. The auxiliary electrode 120 in the proximity of the photo conductor 60 has the auxiliary potential VBIAS3 of approximately −900 V. The positively charged, black toner particles are situated on the auxiliary electrode 120. Since the potential VBIAS3 is lower than the potentials VW2, VR2 and VB2, these potentials are positive with respect to the potential VBIAS3. The positively charged, black toner particles, however, can only be deposited on a surface that has a lower potential with reference to the potential VBIAS3. This is only true of surface elements that were not illuminated in the step S2. Accordingly, the black toner particles are deposited on these surface elements. Due to the deposit of the positively charged toner particles, the potential on the surface elements covered with the black toner particles is raised to a potential value VK3. Due to the unavoidable self-discharge of the photo conductor 60, the potentials VW2, VR2 or, respectively, VB2 are increased slightly to the potential values VW3, VR3 or, respectively, VB3.

In step S4, negative blue toner particles are deposited by the developer station 84. The auxiliary electrode 122 in the immediate proximity of the photo conductor 60 has the auxiliary potential VBIAS4 of approximately −390 V. The negatively charged, blue toner particles are situated on the auxiliary electrode 122. Since the potential VBIAS4 is higher than the potentials VK3, VW3 and VR3, these potentials lie in a negative direction with respect to the potential VBIAS4. The negatively charged, blue toner particles, however, can only be deposited on a surface that has a higher potential with reference to the potential VBIAS4, i.e. a potential shifted in a positive direction. This is only true of surface elements that were illuminated with the third optical energy in the step S2. Accordingly, the blue toner particles are deposited on these surface elements. Due to the deposit of the negatively charged toner particles, the potential on the surface elements covered with the blue toner particles is reduced to a potential value VB4. Due to the unavoidable self-discharge of the photo conductor 60, the potentials VK3, VW3 or, respectively, VR3 are increased slightly to the potential values VK4, VW4 or, respectively, VR4.

In step S5, the potential VB4 on the surface of the surface elements covered with blue toner particles is reduced with the assistance of the charging device 86 to about −390 V, i.e. is shifted in a negative potential direction. Due to the self-discharge of the photoconductor 60, the potentials VK4, VW4 or, respectively, VR4 are increased in the step V5 to the potentials VK5, VW5 or, respectively, VR5.

In step S6—due to the light emitted by the total illumination unit 88—, the potential VW5 or, respectively, VR5 on the surface elements not covered with toner particles is increased by respectively approximately 400 V to the potentials VW6 or, respectively, VR6. The potential on the surface elements that were illuminated with the second optical energy in step S2 becomes the highest potential on one of the surface elements in step S6 due to the further illumination in step S6. The potentials VK5 or, respectively, VB5 increase slightly due to the self-discharge of the photo conductor 60 to the potentials VK6 or, respectively, VB6. A difference of approximately 400 V exists between the potentials VR6 and VB6, so that toner particles can be applied onto those surface elements in the following step S7, similar to step S4, that were illuminated with the second optical energy in step S2.

In step S7, negative, red toner particles are deposited by the developer station 90. The auxiliary electrode 124 in the immediate proximity of the photo conductor 60 has the auxiliary potential VBIAS7 of approximately −370 V. The negatively charged, red toner particles are situated on the auxiliary electrode 124. Analogous to the electrical conditions described in step S4, the negative toner particles are deposited onto the surface elements that were illuminated with the second optical energy in the step S2. Due to the self-discharge of the photo conductor 60, the potentials VK6, VW6 or, respectively, VB6 increase to the potential values VK7, VW7, or, respectively, VB7.

In step S7, the potential VR7 on the surface of the surface elements covered with red toner particles is reduced to the value VR7 due to the deposit of the negatively charged red toner particles. Due to the self-discharge of the photo conductor 60, the potentials VW6, VG6 or, respectively, VB6 are increased to the potentials VW7, VG7 or, respectively, VB7 in step S7.

In step S8, the strip of the photo conductor 60 under consideration is conducted past the recharging station 92. The recharging station 92 contains a corona means that effects a recharging of the potential on the surface of the photoconductor layer 74. When transported past, the potentials on all surface elements are significantly reduced, whereby the polarity of the black toner particles on the photoconductor 60 is reversed, so that the black toner particles are also negatively charged.

In a step S9, the toner particles—due to the influence of the positively charged corona means 70—of surface elements covered with toner particles are transferred onto the carrier material 18, essentially upon retention of their positions relative to one another. The potential of the surface elements of the photo conductor 60 thereby rises to approximately −400 V.

In a step that is not shown, the residual charge still present on the photo conductor 60 is removed by the erasing means 94, so that the photo conductor 60 has a potential value of approximately 0 V on its surface after passing the erasing means 94.

FIG. 4 shows the condition of the surface elements of the photo conductor 60 at the end of the steps S1 through S9. FIG. 4*a* shows a print image 140 that contains four picture elements 142 through 148. The picture element 142 has the color blue B that is shown in FIG. 4*a* by a horizontal hatching.

The picture element 144 has the color red R that is shown in FIG. 4*a* by a vertical hatching. The picture element 146 has the color black K, which is shown in FIG. 4*a* by a slanting hatching whose hatching lines are arranged at approximately 45° relative to the horizontal. The picture element 148 has the color white W (color of the carrier material 18) that is shown in FIG. 4*a* with a hatching whose hatching lines are lined at approximately an angle of 135° with reference to the horizontal.

FIG. 4*b* shows a strip-shaped section 150 of the photo conductor 60. The section 150 is arranged on the photo conductor 60 transversely relative to the conveying direction 76. The section 150 is shown in plan view in FIG. 4, whereby the photo conductor layer 74 is at the top. Due to the print control 34, surface elements 152 through 158 on the surface of the photo conductor 60 have the picture elements 142 through 148 allocated to them. The surface element 152 is allocated to the picture element 142. The surface element 154, 156 or, respectively, 158 is allocated to the picture element 144, 146 or, respectively, 148. The allocation ensues such that neighboring surface elements are also allocated to neighboring picture elements of the print image 140. In step S1, the initial potential VA is generated by the charging means 78 on each of the surface elements 152 through 158.

FIG. 4*c* shows the condition of the surface elements 152 through 158 after the image-wise illumination in step S2. Since the highest, third optical energy is incident onto the surface element 152, a charge compensation occurs over the photo conductor 74 that is highly conductive in the area of the surface element 152 due to the light incidence, the potential VB2 occurring on the surface of the surface element 152 as a result thereof. The surface element 154 is illuminated with the second optical energy that is lower than the third optical energy. Accordingly, the potential VR2 that is lower compared to the potential VB2 occurs on the surface of the surface element 154. The surface element 156 is not illuminated in the image-wise illuminating step. Accordingly, a potential VK2 that lies only slightly above the initial potential VA is established on the surface of the surface element 156 at the end of the image-wise illuminating step S2. After being illuminated with the first optical energy in step S2, the potential VW2 is established on the surface of the surface element 158. Since the first optical energy is lower than the second optical energy, the potential VW2 is lower than the potential VR2.

A surface element not covered with toner particles that has the highest potential at the end of one of the steps S2 through S9 is identified by an asterisk in the upper right comer of the respective surface element. A surface element not covered with toner particles that has the lowest potential at the end of one of the steps S2 through S9 is identified by an cross in the upper right comer of the respective surface element. The surface element 152 has the highest potential and the surface element 156 has the lowest potential in FIG. 4*c*.

FIG. 4*d* shows the surface potentials on the surface elements 152 through 158 at the end of the step S3. During step S3, the section 150 is conveyed past the developer station 82. For the aforementioned reasons, black toner particles deposit only on the surface of the surface element 156, so that this surface element is completely covered with black toner particles (which is shown by 45° hatching).

FIG. 4*e* shows the surface potentials on the surface elements 152 through 158 at the end of the step S4. During step S4, the section 150 is conveyed past the developer station 84. For the aforementioned reasons, blue toner particles deposit only on the surface of the surface element 152, so that both the surface element 152 as well as the surface element 156 are now covered with toner particles.

FIG. 4*f* shows the surface elements 152 through 158 at the end of the step S6 in which the section 150 was uniformly illuminated. Due to the uniform illumination, an increase in potential occurs on the surface of the surface elements 154 and 158 that are not covered with toner particles since the incident light reduces the resistance of the photo conductor layer 74 and a partial charge carrier compensation between charge carriers on the surface of these surface elements and charge carriers in the electrode layer 72 occurs. At the end of the step S6, the surface element 154 has the highest potential on its surface.

FIG. 4*g* shows the surface elements 152 through 158 at the end of the step S7. During the course of this step, the section 150 is conveyed past the developer station 90. For the aforementioned reasons, red toner particles deposit on the surface element 154 (as shown by vertical hatching). The surface elements 152 through 156 are thus covered with toner particles.

FIG. 4*h* shows a section 160 of the carrier material 18 at the end of the step S9. The toner particles on the section 150 are transferred onto the section 160 of the carrier material 18, essentially retaining their mutual positions. As already mentioned, the carrier material 18 has the color white W (which is represented by 135° hatching), so that the print image 140 having the picture elements 142 through 148 was printed onto the section 160 of the carrier material 18 as a result of the described method.

When printing with the printer 10, for example given a resolution of 600 picture elements per 25.4 mm, an image element has a width of approximately 0.044 mm, so that the illustrations in FIGS. 4*a*–4*h* are a great enlargement with a magnification factor of approximately 200. The human eye can not individually resolve the picture elements given a standard reading distance of approximately 30 cm. Accordingly, mixed color effects derive. The blue picture element 142 and the red picture element 144, for example, yield the mixed color violet perceived by the eye.

Proceeding from the above-described method for three colors, one arrives at a method with n colors in that the initial potential VA is selected approximately equal to n times the potential required for an individual developing step. In the image-wise illuminating step, moreover, at least n different optical energies must be generated per picture element, so that n+1 different potentials can be generated. Steps S5 through S7 are repeated a further n−3 times following the step S7. The letter n is thereby a natural number that can assume the values 4, 5, etc.

Figure 5:
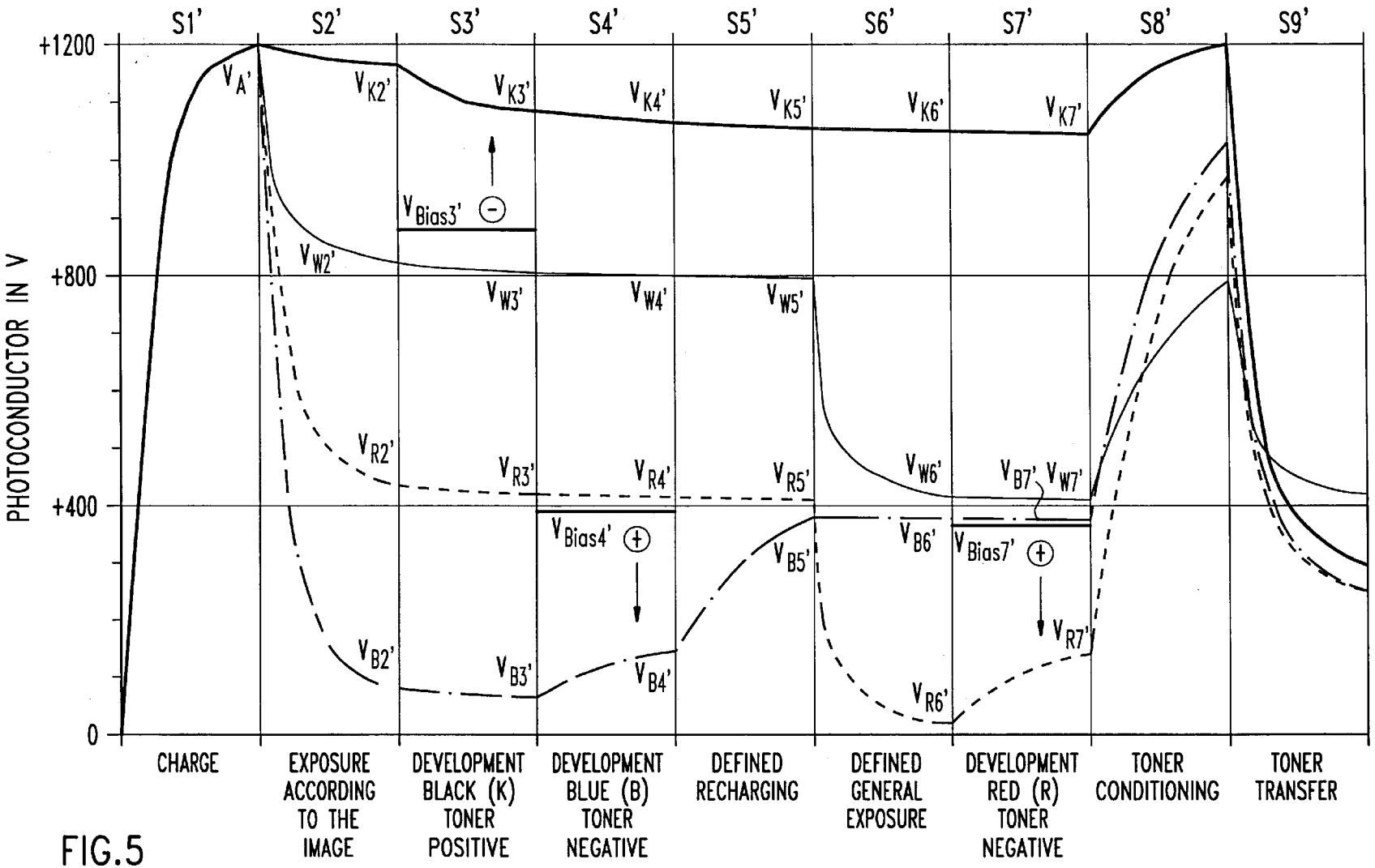
FIG. 5 is a graph showing a second curve of potential on the photo conductor given an exposing step and two toner polarities.

FIG. 5 shows a second curve of potential on the surface of surface elements or regions of the photo conductor 60 given an illumination step and two toner polarities. The curve of potential shown in FIG. 5 is valid for a printer that contains a printing unit 20' (not shown) that differs from the printing unit 20 in that the corona means 70, the charging means 78, the charging means 86, the recharging station 92 and the corona means 98 are operated with the opposite operating voltage. Instead of the developer station 82, moreover, a developer station is employed that deposits negative toner particles having the color black with the assistance of an auxiliary electrode having the potential VBIAS3' of approximately +900 V. Instead of the developer station 84, a developer station for positively charged, blue toner particles is employed. The auxiliary electrode for applying the blue toner particles has an auxiliary potential VBIAS4' of approximately +390 V. A developer station for positively charged, red toner particles is employed instead of the developer station 90. An auxiliary electrode with an auxiliary potential VBIAS7' of approximately +370 V is employed when depositing the red toner particles.

The curve of potential shown in FIG. 5 differs from the curve of potential of FIG. 3 in that the operational signs of the potentials are reversed compared to FIG. 3. Taking the operational signs into consideration, the statements made on the basis of FIG. 3 also apply to the curve of potential of FIG. 5. Instead of steps S1 through S9, steps S1' through S9' are now entered. Instead of the potential VA, a potential VA' that has an opposite operational sign is employed in FIG. 5. Moreover, potentials VK2' through VK7', VW2' through VW7', VR2' through VR7' or, respectively, VB2' through VB7' modified in terms of operational sign replace the potentials VK2 through VK7, VW2 through VW7, VR2 through VR7 or, respectively, VB2 through VB7

Although other modifications and changes may be suggested by those skilled in the art, it is the intention of the inventors to embody within the patent warranted hereon all changes and modifications as reasonably and properly come within the scope of their contribution to the art.

What is claimed is:

1. A method for electrophotographic printing of a print image with a plurality of colors on a carrier, comprising the steps of:

charging a layer system to a starting potential, generating at least three different potentials on the layer system by image-wise illuminating, one potential of said three potentials having a value that is greater in terms of amount than another potential of said at least three different potentials and a first potential of said at least three different potentials having a value that is greater in terms of amount than said one potential, in a developing step with first color particles of a first color and first polarity, applying said first color particles onto locations having said first potential, in a developing step with second color particles of a second color and of a second polarity, applying said second color particles onto locations having said another potential, increasing potential on locations already covered with color particles in terms of amount at least once, lowering said one potential in terms of amount by uniform illuminating to a value below a momentary value of said another potential that is present after said developing step with said second color particles of the said second color, and, in a developing step with third color particles of a third color of the second polarity, applying said third color particles at locations having the lowered one potential.

2. A method according to claim 1, wherein said layer system includes a photo conductor layer and an electrode layer carrying a predetermined reference potential and comprising the steps of:

providing the print image with at least one first image element of said first color, at least one second image element having a color of the carrier, at least one third image element having said third color, and at least one fourth image element having said second color, allocating a first surface element of said photo conductor layer to the at least one first image element, allocating a second surface element of said photo conductor layer to the at least one second image element, allocating a third surface element of said photo conductor layer to the at least one third image element, and allocating a fourth surface element of the photo conductor layer to the at least one fourth image element, wherein said charging step includes charging the first and second and third and fourth surface elements to a negative starting potential;

wherein said generating step includes differently illuminating the first and second and third and fourth surface elements such that said first surface element has said first potential, said second surface element has a second potential, said third surface element has a third potential and the fourth surface element has a fourth potential being said another potential and the third potential being said one potential that is higher in amount compared to the fourth potential and the second potential being higher in amount compared to the third potential and the first potential being higher in terms of amount compared to the second potential following illumination;

wherein in said developing step with said first color particles the surface elements are developed with said first color particles of the first color, including depositing positively charged first color particles of the first color on the first surface element upon employment of a first auxiliary electrode that has a first auxiliary potential that is higher in terms of amount than a momentary potential on the second surface element and lower in terms of amount than a momentary potential on the first surface element;

wherein in said developing step with said second color particles the surface elements are developed with second color particles of the second color, including depositing negatively charged second color particles of the second color on the fourth surface element upon employment of a second auxiliary electrode that has a second auxiliary potential that is higher in terms of amount than a momentary potential on the fourth surface element and lower in terms of amount than a momentary potential on the third surface element;

wherein said step of increasing potential includes arranging the surface elements close to a light source having an approximately uniform light distribution so that the first surface element covered with said first color particles and the fourth surface element covered with said second color particles are illuminated substantially less than the second surface element and the third surface element which are not covered with color particles, said illuminating being for a duration sufficient to cause a momentary potential on the third surface element to be reduced in terms of amount to a potential that is lower in terms of amount than a momentary potential on the fourth surface element; and wherein in said developing step with third color particles the surface elements are developed with third color particles of the third color, including depositing negatively charged third color particles of the third color on the third surface element upon employment of a third auxiliary electrode that has a third auxiliary potential that is higher in terms of amount than a momentary potential on the third surface element and lower in terms of amount than a momentary potential on the fourth surface element and a momentary potential on the second surface element.

3. A method according to claim 1, wherein said layer system includes a photo conductor layer and an electrode layer carrying a predetermined reference potential and comprising the steps of:

providing the print image with at least one first image element of said first color, at least one additional image element of said third color and at least one another image element of said second color, allocating a first surface element of said photo conductor layer to the at least one first image element, allocating an additional surface element of said photo conductor layer to the additional image element and allocating another surface element of the photo conductor layer to the another image element, wherein said charging step includes charging the first surface element and said additional surface element and said another surface element to a negative starting potential, wherein said generating step includes differently illuminating the first surface element and said additional surface element and said another surface element such that the another surface element has said another potential and the additional surface element has an additional potential that is higher in terms of amount compared to the another potential and the first surface element has said first potential that is higher in terms of amount compared to the additional potential, wherein in said developing step with said first color particles the surface elements are developed with said first color particles of the first color, including depositing positively charged first color particles of the first color on the first surface element upon employment of a first auxiliary electrode that has a first auxiliary potential that is higher in terms of amount than a momentary potential on the additional surface element and lower in terms of amount than a momentary potential on the first surface element, wherein in said developing step with said second color particles the surface elements are developed with said second color particles of the second color, including depositing negatively charged second color particles of the second color on the another surface element upon employment of a second auxiliary electrode that has a second auxiliary potential that is higher in terms of amount than a momentary potential on the another surface element and lower in terms of amount than a momentary potential on the additional surface element, wherein said step of increasing potential includes arranging the surface elements close to a light source having an approximately uniform light distribution so that the first surface element covered with said first color particles and the another surface element covered with said second color particles are illuminated substantially less than the additional surface element which is not covered with color particles, said arranging being for a duration sufficient to cause a momentary potential on the additional surface element to be reduced in terms of amount to a potential that is lower in terms of amount than a momentary potential on the another surface element, wherein in said developing step with said third color particles the surface elements are developed with said third color particles of the third color, including depositing negatively charged third color particles of the third color on the additional surface element upon employment of a third auxiliary electrode that has a third auxiliary potential that is higher in terms of amount than a momentary potential on the additional surface element and lower in terms of amount than a momentary potential on the another surface element.

4. A method according to claim 3, wherein the print image contains at least one further picture element of a further color, comprising the steps of:

allocating the further picture element to a further surface element of the photo conductor layer, charging the further surface element to the starting potential, illuminating the further surface element such that said further surface element has a further potential that is higher in terms of amount than the additional potential and lower in terms of amount than the first potential following the illumination, repeatedly arranging the surface elements close to an additional light source so that said further surface element which is not covered with color particles is considerably more illuminated than surface elements covered with color particles, said arranging step causing the potential on the further surface element to be reduced in terms of amount, and developing the surface elements with color particles of the further color, including depositing negatively charged color particles of the further color on the further surface element upon employment of a further auxiliary electrode that has a further auxiliary potential that is higher in terms of amount than a momentary potential on the further surface element and lower in terms of amount than a momentary potentials on the other surface elements.

5. A method according to claim 1, further comprising the step of:

recharging deposited color particles having a positive polarity to a negative polarity.

6. A method according to claim 1, wherein said layer system includes a photo conductor layer and an electrode layer carrying a predetermined reference potential and comprising the steps of:

providing the print image with at least one first image element of said first color, at least one second image element having a color of the carrier, at least one third image element having said third color, and at least one fourth image element having said second color, allocating a first surface element of said photo conductor layer to the at least one first image element, allocating a second surface element of said photo conductor layer to the at least one second image element, allocating a third surface element of said photo conductor layer to the at least one third image element, and allocating a fourth surface element of the photo conductor layer to the at least one fourth image element, wherein said charging step includes charging the first surface element and said second surface element and said third surface element and said fourth surface element to a positive starting potential, wherein said generating step includes differently illuminating the surface elements such that the third surface element has said one potential and the second surface element has a second potential higher in amount compared to the one potential and the first surface element has said first potential that is higher in terms of amount compared to the second potential following illumination, wherein in said step of developing with the third color particles the surface elements are developed with third color particles of the third color, including depositing positively charged third color particles of the third color on the third surface element upon employment of a first auxiliary electrode that has a first auxiliary potential that is higher in terms of amount than a momentary potential on the third surface element and lower in terms of amount than a momentary potential on the second surface element, wherein said step of increasing potential includes arranging the surface elements close to a light source having an approximately uniform light distribution so that the third surface element covered with third color particles is illuminated substantially less than the first surface element and the second surface element which are not covered, said arranging for a duration sufficient to cause a momentary potential on the second surface element to be reduced in terms of amount to a potential that is lower in terms of amount than a momentary potential on the third surface element, developing the surface elements with color particles of the second color, including depositing positively charged second color particles of the second color on the fourth surface element upon employment of a second auxiliary electrode that has a second auxiliary potential that is higher in terms of amount than a momentary potential on the fourth surface element and lower in terms of amount than a momentary potential on the third surface element and a momentary potential on the first surface element.

7. A method according to claim 1, wherein said layer system includes a photo conductor layer and an electrode layer carrying a predetermined reference potential and comprising the steps of:

providing the print image with at least one first image element of said first color, at least one additional image element having said third color, and at least one another image element having said second color, allocating a first surface element of the photo conductor layer to the first image element, allocating an additional surface element of the photo conductor layer to the additional image element, and allocating another surface element of the photo conductor layer is allocated to the another image element, wherein said charging step includes charging the surface elements to a positive starting potential;

wherein said generating step includes differently illuminating the surface elements such that the another surface element has said another potential and the additional surface element has an additional potential higher in amount compared to the another potential, and the first surface element has said first potential that is higher in terms of amount compared to the additional potential;

wherein in said developing step with the first color particles the surface elements are developed with first color particles of the first color, including depositing negatively charged first color particles of the first color on the first surface element upon employment of a first auxiliary electrode that has a first auxiliary potential that is higher in terms of amount than a momentary potential on the additional surface element and lower in terms of amount than a momentary potential on the first surface element;

wherein in said developing step with the second color particles the surface elements are developed with second color particles of the second color, including depositing positively charged second color particles of the second color on the another surface element upon employment of a second auxiliary electrode that has a second auxiliary potential that is higher in terms of amount than a momentary potential on the another surface element and lower in terms of amount than a momentary potential on the additional surface element;

wherein said step of increasing potential includes positioning the surface elements close to a light source having an approximately uniform light distribution so that the first surface element covered with first color particles and the another surface element covered with second color particles are illuminated substantially less than the additional surface element which is not covered, said positioning the surface elements close to a light source causing a momentary potential on the additional surface element to be reduced in terms of amount to a potential that is lower in terms of amount than a momentary potential on the another surface element;

wherein in said step of developing with said third color particles the surface elements are developed with third color particles of the third color so that positively charged third color particles of the third color are deposited on the additional surface element upon employment of a third auxiliary electrode that has a third auxiliary potential that is higher in terms of amount than a momentary potential on the additional surface element and lower in terms of amount than a momentary potential on the another surface element.

8. A method according to claim 6, further comprising the steps:

providing the print image with at least one further image element of a further color, allocating the further image element to a further surface element of the photo conductor layer, charging the further surface element to the positive starting potential, illuminating the further surface element such that said further surface element has a further potential that is higher in terms of amount than the one potential and lower in terms of amount than the second potential, repeatedly arranging the surface elements close to an additional light source so that the further surface element which is not covered is respectively illuminated considerably more than the surface elements covered with color particles causing the potential on the further surface element to be reduced in terms of amount, and developing the surface elements with color particles of the further color, including depositing positively charged color particles of the further color on the further surface element upon employment of a further auxiliary electrode that has a further auxiliary potential that is higher in terms of amount than a momentary potential on the further surface element and lower in terms of amount than a momentary potentials on the other surface elements.

9. A method according to claim 6, further comprising the steps of:

wherein in said developing step with said first color particles, the surface elements are developed with said first color particles of the first color, including depositing negatively charged first color particles of the first color on the first surface element upon employment of an additional auxiliary electrode that has an additional auxiliary potential that is higher in terms of amount that a momentary potential on the second surface element and lower in terms of amount than a momentary potential on the first surface element;

recharging said negatively charged first color particles which have been deposited onto the photo conductor layer in said developing step with said first color particles to a positive polarity.

10. A method according to claim 1, further comprising the step of:

transferring said first and second and third color particles which have been deposited onto a photo conductor layer in said developing steps onto the carrier from the photo conductor layer while substantially retaining their mutual positions.

11. A method according to claim 1, further comprising the step of:

transferring deposited color particles onto an intermediate carrier while substantially retaining their mutual positions, and transferring the color particles from the intermediate carrier onto the carrier while substantially retaining their mutual positions.

12. An electrophotographic printer, comprising:

a light-sensitive layer system that contains an electrode layer carrying a predetermined reference potential and a photo conductor layer, a charging means for generating a starting potential on the photo conductor layer, an illumination means for image-wise illumination of the photo conductor layer, a first developer station for applying color particles of a first polarity and a first color onto the light-sensitive layer system, a second developer station for depositing color particles of a second polarity and a second color onto the layer system, at least one total illumination unit for uniform illumination, at least one further developer station for applying color particles of the second polarity and a further color onto the layer system, and at least one potential-increasing means for increasing a respective lowest potential on the layer system in terms of amount.

13. An electrophotographic printer according to claim 12, further comprising:

a recharging station for charging the applied color particles of the first polarity to the second polarity.

14. An electrophotographic printer according to claim 12, further comprising:

a transfer means for transferring the applied color particles from the layer system onto a carrier.

15. An electrophotographic printer according to claim 12, further comprising:

an erase means for erasing a residual charge image on the layer system.

16. An electrophotographic printer according to claim 12, further comprising:

a cleaning means for cleaning the layer system.

17. An electrophotographic printer, comprising:

a light-sensitive layer system that contains an electrode layer carrying a predetermined reference potential and a photo conductor layer;

a charging station for generating a starting potential on the photo conductor layer;

a character generator for image-wise illumination of the photo conductor layer;

a first developer station for applying color particles of a first polarity and a first color onto the light-sensitive layer system;

a second developer station for depositing color particles of a second polarity and a second color onto the layer system;

at least one illumination unit for uniform illumination;

at least one further developer station for applying color particles of the second polarity and a further color onto the layer system; and at least one potential-increasing station for increasing a respective lowest potential on the layer system in terms of amount.

* * * * *